US007581318B2

(12) United States Patent
Coffin

(10) Patent No.: US 7,581,318 B2
(45) Date of Patent: Sep. 1, 2009

(54) SKIN ENGAGING DEVICE FOR A SAFETY RAZOR

(75) Inventor: David C. Coffin, Hamden, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 11/499,499

(22) Filed: Aug. 3, 2006

(65) Prior Publication Data

US 2008/0028617 A1 Feb. 7, 2008

(51) Int. Cl.
*B26B 21/40* (2006.01)

(52) U.S. Cl. ..... 30/41; 30/50

(58) Field of Classification Search ..... 30/41, 30/41.5, 50, 84, 537, 538
See application file for complete search history.

(56) References Cited

U.S. PATENT DOCUMENTS

| | | | | |
|---|---|---|---|---|
| 4,170,821 | A | 10/1979 | Booth | |
| 4,586,255 | A | 5/1986 | Jacobson | |
| 5,113,585 | A | 5/1992 | Rogers et al. | |
| 5,915,791 | A | 6/1999 | Yin et al. | |
| 6,145,201 | A * | 11/2000 | Andrews | 30/50 |
| 6,182,365 | B1 * | 2/2001 | Tseng et al. | 30/34.2 |
| 6,295,733 | B1 * | 10/2001 | Wexler et al. | 30/41 |
| 6,298,558 | B1 | 10/2001 | Tseng et al. | |
| 7,069,658 | B2 * | 7/2006 | Tseng | 30/41 |
| 2003/0182802 | A1 * | 10/2003 | Vega et al. | 30/50 |
| 2004/0181949 | A1 * | 9/2004 | Coffin et al. | 30/346.57 |

FOREIGN PATENT DOCUMENTS

WO 96/02369 2/1996

OTHER PUBLICATIONS

International Search Report dated Dec. 3, 2007.
Written Opinion of the International Searching Authority dated Feb. 12, 2009 regarding International Application No. PCT/US2007/017164.

* cited by examiner

*Primary Examiner*—Hwei-Siu C Payer
(74) *Attorney, Agent, or Firm*—Energizer Personal Care, LLC

(57) ABSTRACT

An improved skin engaging device for use in razor cartridge assemblies and shaving systems of the wet shave type. In an embodiment, there is provided a two-component, control-release device having a sheath layer made from thermoplastic resins with openings in its skin engaging surface, coextruded with a core region containing shaving aids. At least one end of the device is at least partially closed to inhibit the ingress of water at that end of the device and to inhibit the release of the shaving aid from that end of the device during a normal shaving operation. Enclosure of the end of the device can be by addition of an end cap, by application of a film of a suitable sealant or by suitably joining opposed inner walls of a portion of the sheath extending beyond the core.

3 Claims, 4 Drawing Sheets

SKIN ENGAGING DEVICE FOR A SAFETY RAZOR

BACKGROUND

1. Technical Field

This invention relates generally to wet shaving apparatus, and more specifically to razor cartridges having an improved skin engaging device. The present invention resides broadly in providing skin engaging cap and/or guard surfaces with configurations which deliver a shaving aid as the razor is moved across the skin.

2. Background Information

In shaving systems of the wet shave type, factors that include but are not limited to the frictional drag of the razor across the skin, the force needed to sever hairs, and irritation of pre-existing skin damage can create a degree of shaving discomfort. Discomfort, and other problems accompanying wet shaving systems, can be alleviated by the application of shaving aids to the skin. Shaving aids can be applied prior to, during, or after shaving. A number of problems accompany the use of pre- and post-applied shaving aids. Pre-applied shaving aids can evaporate, can be carried away from the application site by repeated strokes of the razor or can be washed away from the application site by the application of water. Post-applied shaving aids are not present on the skin during shaving and thus their application can be too late to prevent an unwanted affect. Both pre-applied and post-applied shaving aids add additional steps to the shaving process.

Many previous proposals have been made to incorporate a shaving aid, for example a lubricant, whisker softener, razor cleanser, medicinal agent, cosmetic agent or combination thereof, into a razor for example by depositing a shaving aid in a recess on the razor, by incorporating a shaving aid directly into one or more molded polymeric components of the razor, by adhesively securing a shaving aid composite to the razor, and by use of a mechanical connection between a shaving aid composite and the razor. A water-soluble shaving aid, e.g. polyethylene oxide, has been mixed with water insoluble matrix material, for example a polystyrene polymer, to form an insoluble polymer/soluble shaving aid composite as disclosed in U.S. Pat. No. 4,170,821 to Booth and U.S. Pat. No. 5,113,585 to Rogers. The composite has been mounted on razor and shaving cartridge structures, adjacent the shaving edge or edges, of single or multiple blade shaving systems. Upon exposure to water, the water-soluble shaving aid leaches from the composite onto the skin. These composites tend to release large amounts of shaving aid in the first few shaves and dramatically less shaving aid in subsequent shaves. Furthermore, extruded composites with relatively large amounts of shaving aid (up to 80% by weight) and relatively low amounts of water insoluble matrix material (as little as 20% by weight) are relatively weak and have a tendency towards mechanical failure, both in manufacture and assembly and in use. Increased mechanical strength can be obtained with increased amounts of the insoluble matrix material. However, such increase reduces the proportion of shaving aid material in the composite and the releasability of the shaving aid material.

Commercial lubricating strips, especially those with high levels of polyethylene oxide lubricant like those described in the aforementioned Patents tend to deteriorate after use. Leach rate varies during the course of shaving and typically about 50% of the polyethylene oxide can be trapped in the strip. The selection of the polyethylene oxide carrier (i.e., the non-water soluble matrix material) is limited to a carrier that has a low melting or softening temperature and is at least partially miscible with polyethylene oxide. In addition, because the strip is made at a high temperature of approximately 180° C., additives such as fragrances and plasticizers are difficult to incorporate in the strips.

U.S. Pat. No. 6,298,558 to Tseng et al, the subject matter of which is incorporated for reference herein in its entirety, discloses an improved device for use in razor cartridge assemblies and shaving systems of the wet shave type. In one embodiment, there is provided a two-component, control-release shaving device consisting of a sheath layer made from thermoplastic resins with openings therein and a core region containing internal shaving aids. Potentially, the device can maintain surface appearance, control-release the shaving aids, minimize the degradation of the shaving aids, minimize the shaving aids trapped in a strip and provide a device which is easy to manufacture and/or which is easily integrated with a razor cartridge system. The '558 Patent discloses a manufacturing method whereby the device is produced by providing a two-component extrusion, or coextrusion, that is cut to length suitable for implant into or onto the body of a razor blade cartridge. Cutting-to-length exposes the core portion at both ends of the device. Upon contact with water in use, the device can undergo accelerated leaching of the shaving aid from the exposed ends of the core and leaching in a direction where the shaving aid is not deposited on the skin and is thus wasted. As many shaving aids tend to swell upon contact with water, the exposed ends of the device can expand uncontrollably which can lead to premature failure of the entire device.

Based on the foregoing, it is desirous to provide a coextruded device for the delivery of shaving aid material(s) for a razor cartridge or shaving system having a sheath of a water insoluble polymer and a core including a water soluble shaving aid. The device is cut to length and the end portions are closed to inhibit the ingress of water in use and inhibit premature leaching of the shaving aid or premature failure of the device.

SUMMARY

The razor cartridge or shaving system of the present invention comprises a housing, at least one razor blade and a device for delivery of a shaving aid to a skin surface of a user during a normal shaving operation. The device comprises an elongated solid polymeric sheath including a water insoluble polymer and an internal solid polymeric core coextruded with the sheath. The core contains 50% to 100% by weight of a solid shaving aid comprising polyethylene oxide. The sheath has a skin engaging surface extending along its outer surface and at least one opening in the skin engaging surface through which the shaving aid is released. The ends of the device are at least partially closed to inhibit the ingress of water and the release of the shaving aid from the end of the device.

In one embodiment of the present invention the sheath at one end of the device extends axially beyond the core. One portion of the extended sheath is bonded, for example by a suitable adhesive, or welded, for example by ultrasonic welding, to another portion of the extended sheath to at least partially close that end of the device.

In another embodiment of the present invention a sealant is applied to one end of the device. The sealant is selected for properties that include the inability to excessively penetrate the core. For ease of application the sealant can conveniently be in a volatile carrier.

In a still further embodiment of the present invention the end of the device is at least partially closed by an end cap. The end cap can be formed from a molded polymeric material or a drawn metallic material. The end cap can be bonded or welded to the device as described above or mechanically affixed.

Embodiments of the invention can include one or more of the following advantages. The end portions of the device are closed to inhibit the ingress of water in use and inhibit premature leaching of the shaving aid or premature failure of the device. The above features and advantages of the present invention will be more fully understood with reference to the following detailed description when taken in conjunction with the accompanying drawings.

DETAILED DESCRIPTION

Figure 1:
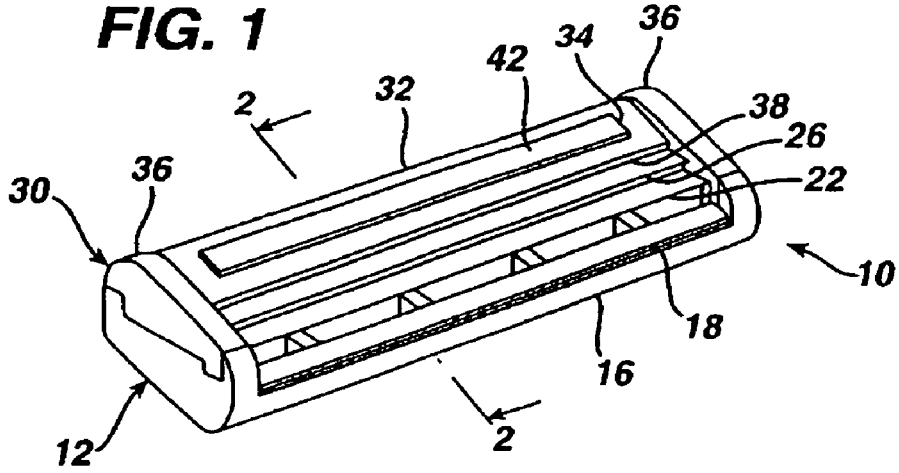
FIG. 1 is a perspective view of an embodiment of a razor cartridge of the present invention.
Figure 2:
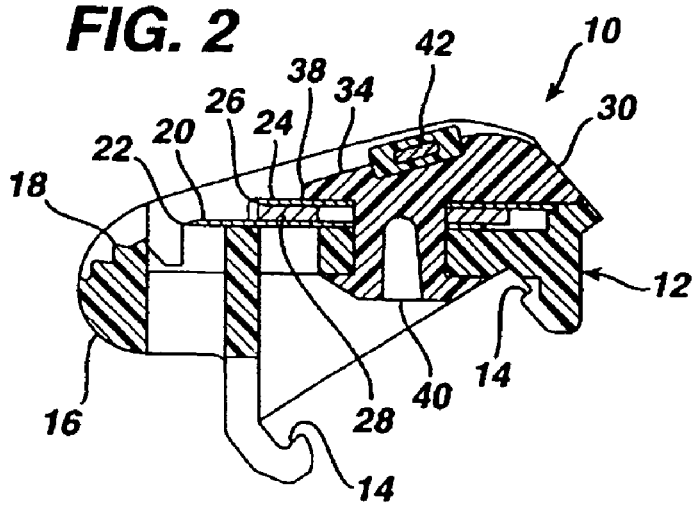
FIG. 2 is a sectional view taken along the line 2-2 of FIG. 1.

Referring to the drawings, the shaving unit 10 shown in FIGS. 1 and 2 includes base or platform member 12 molded of ABS or other suitable polymer that includes integral coupling groove structure 14 for attachment to a razor handle and guard structure 16 that defines a transversely extending anterior skin engaging surface 18. On the upper surface of platform 12 are disposed leading razor blade 20 having a cutting edge 22, trailing razor blade 24 having cutting edge 26, and aluminum spacer member 28 that maintains razor blades 20 and 24 in spaced relation. Cap member 30 is also molded of ABS or other suitable polymer and has body portion 32 that defines the posterior skin engaging surface 34 that extends transversely between forwardly projecting end walls 36 and has a front edge 38 that is disposed rearwardly of blade edge 26. Integral rivet portions 40 extend downwardly from transversely extending body portion 32 and pass through holes in blades 20 and 24, spacer 28 and platform 12 to secure cap 30, blades 20, 24 and spacer 28 on platform 12. Adhesively affixed to skin engaging surface 34 is device 42.

Figure 3:
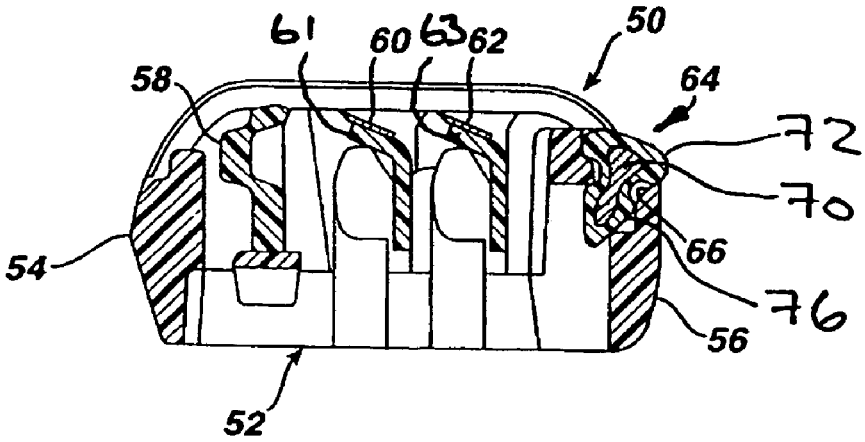
FIG. 3 is a sectional view of another embodiment of a razor cartridge of the present invention.

The shaving unit 50 shown in FIG. 3 is of the type shown in U.S. Pat. No. 4,586,255 to Jacobson, incorporated herein by reference, and includes body 52 with front portion 54 and rear portion 56. Guard member 58 can be resiliently or rigidly mounted to the body and can also comprise a plurality of elastomeric fins as is well known in the art. The shaving unit includes leading razor blade 60 mounted to a bent support 61 and trailing razor blade 62 mounted to a bent support 63. One of skill in the art will understand that the shaving unit may comprise one, two or three or more razor blades and the present invention is not limited in this regard. A shaving aid composite in the form of elongated device 64 is frictionally locked in opening 66 of rear portion 56.

Figure 4:
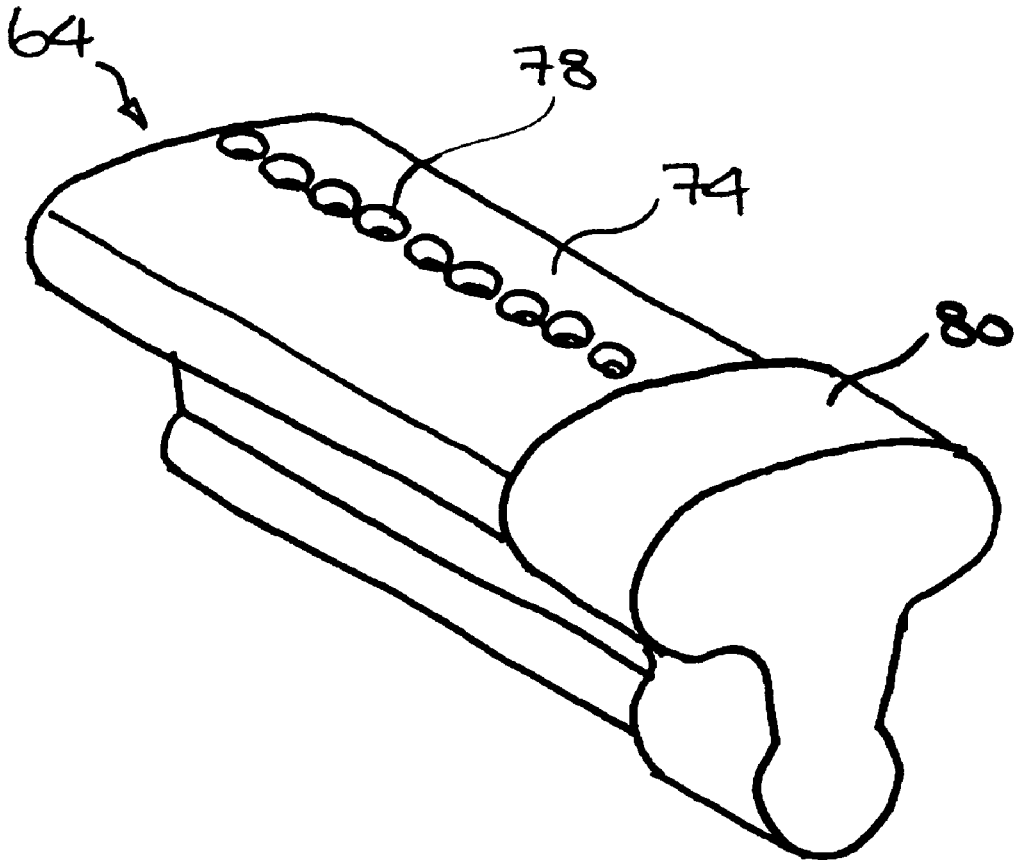
FIG. 4 is an enlarged perspective view of a device of the present invention.
Figure 5:
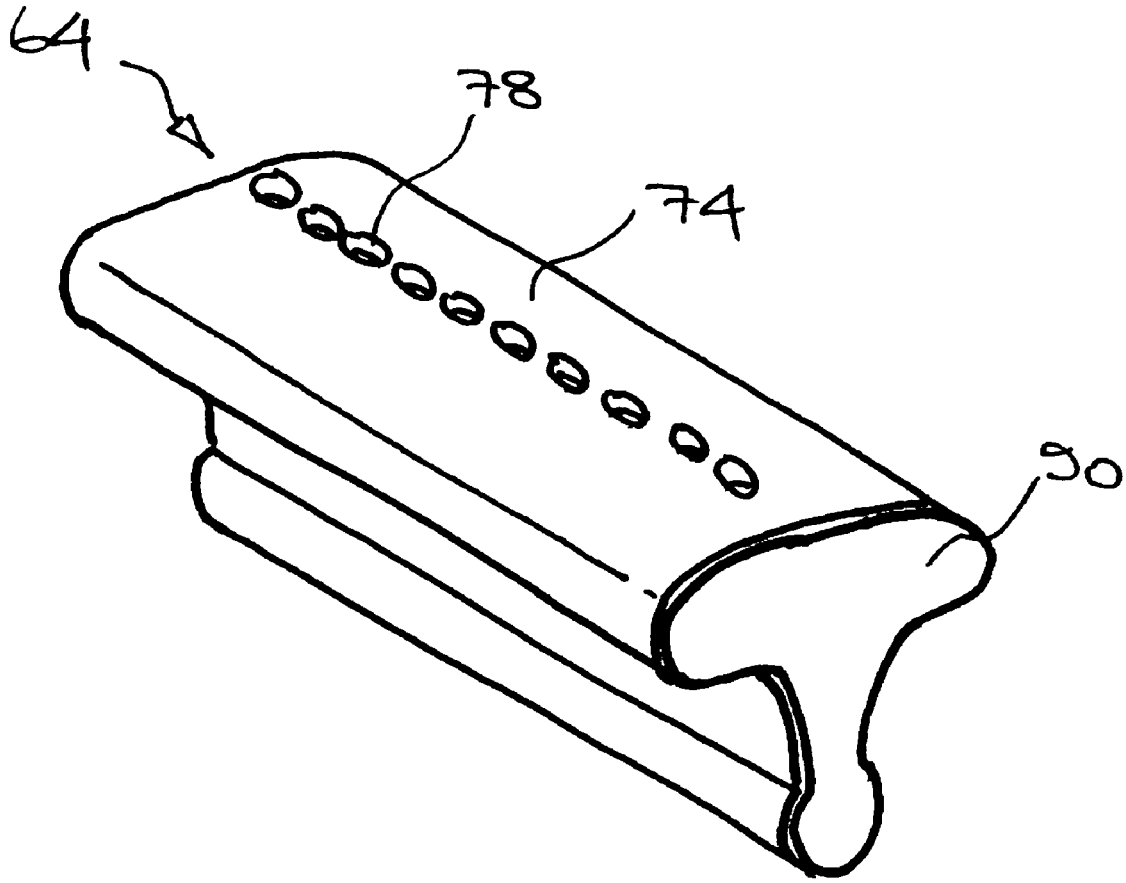
FIG. 5 is an enlarged perspective view of another embodiment of the device of the present invention.
Figure 6:
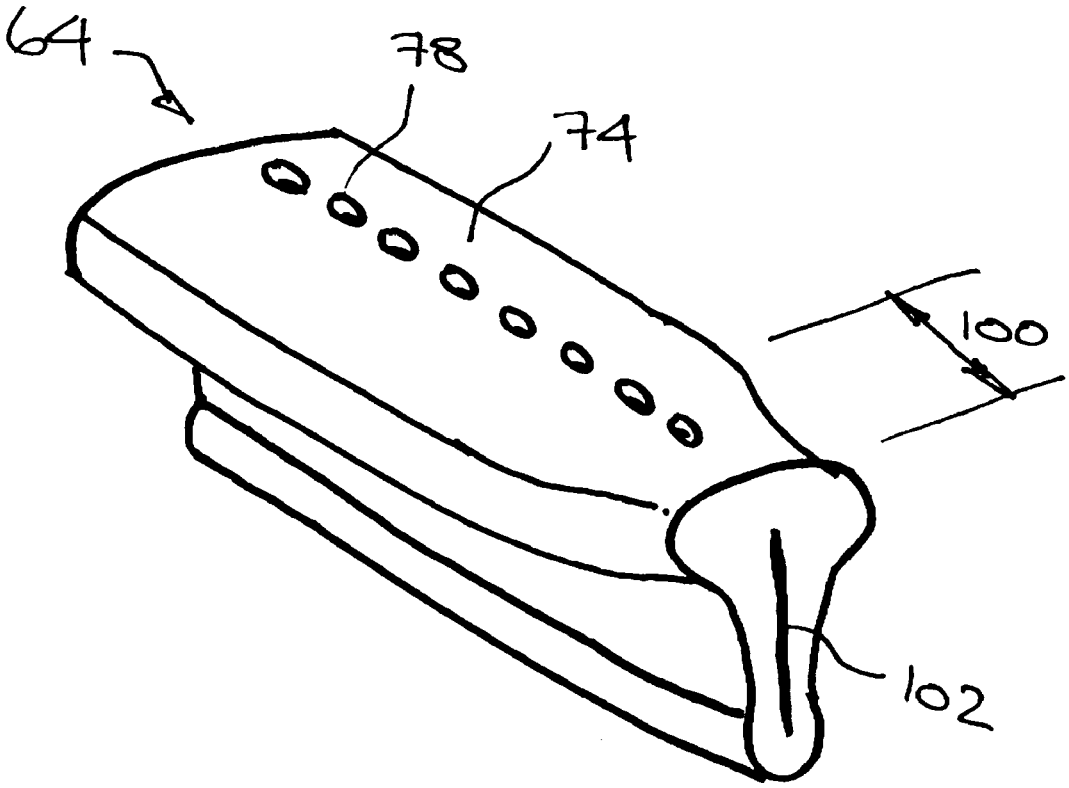
FIG. 6 is an enlarged perspective view of another embodiment of the device of the present invention.

FIGS. 4-6 generally depict variations on the present invention. As used herein, the term "core" refers to an internal portion of a skin engaging member as examined at the cross-section. The core typically runs throughout the skin engaging member along an axis. The axis need not be the central axis. The FIG. 3 designates the core as 70 and the sheath as 72. Embodiments of the present invention have at least one core. As used herein, the term "sheath" refers to an outer coating layer(s) over the core 70. The device 64 comprising the core and sheath is preferably manufactured by a two-component or coextrusion process and cut to length suitable for implant into or onto the body of the razor blade cartridge. The core comprises 50-100% by weight of a solid, water soluble, shaving aid comprising polyethylene oxide. Preferred materials of the sheath are disclosed in U.S. Pat. No. 6,298,558 to Tseng et al. incorporated herein for reference. The skin engaging surface 74 of the sheath has at least one opening 78 to release shaving aid to the skin. Preferably, the device includes from about 3 to about 30 openings 78, most preferably 10-15 openings, preferably evenly distributed along the skin engaging surface 74. The skin engaging surface of the sheath can also comprise a soft layer such as a commercial strip (polyethylene oxide/polystyrene) which will become porous during use. Referring to FIG. 3 the device has an elongated insert member 76. The insert member 76 is designed to frictionally lock in an opening 66 as shown in FIG. 3.

FIG. 4 depicts an exemplary embodiment of the present invention. End cap 80 is mounted to an end of the device 64 to at least partially close that end to inhibit the ingress of water to that end of the device and to inhibit the release of the shaving aid from the exposed core. The end cap can be manufactured from a molded polymeric material, most preferably from a polymeric material chosen for its ability to be readily ultrasonically welded to the sheath. The end cap can also be bonded to the device by a suitable adhesive, preferably a cyanoacrylate adhesive, most preferably the grade designated LOCTITE 420 manufactured by HENKEL. The end cap can also be manufactured from a drawn metal, preferably an aluminum alloy and bonded to the device as previously described. A drawn metal end cap can also be mechanically affixed to the device by piercing the wall of the end cap so that a portion of the end cap penetrates the device to prevent removal.

FIG. 5 depicts another embodiment of the present invention. An end of the device exposed by the cut-to-length process is at least partially closed by the application of a suitable film of sealant, 90. The sealant is preferably a lacquer having a volatile component that evaporates after application. The sealant is selected at least for its ability to bond to the sheath to provide a durable film, and for its inability to penetrate the core so that it does affect the release of the shaving aid material through the openings 78 during normal shaving. The sealant can also be a room temperature vulcanizing (RTV) material comprising silicone or a two-part epoxy.

FIG. 6 depicts a further embodiment of the present invention. A short length 100 at an end of the device is crushed or otherwise squeezed to expel a portion of the core local to the crushed portion. The inner opposed walls of the sheath are preferably ultrasonically or otherwise welded together to form seam 102 to at least partially close that end of the device. The inner opposed sheath walls can also be bonded together as described above.

It is to be understood that the present invention is by no means limited to the particular construction herein disclosed and/or shown in the drawings, but also comprises any modifications or equivalents within the scope of the disclosure.

What is claimed is:

1. A razor cartridge, comprising:

a housing, a blade and a device for delivery of a shaving aid to a skin surface of a user, comprising opposing ends, and further comprising an elongated solid polymeric sheath comprising a water insoluble polymer, the sheath having a skin engaging surface extending along an outer surface thereof, and an internal solid polymeric core coextruded with the sheath and extending axially at least partially throughout and surrounded by the sheath, the core containing 50% to 100% by weight of a solid shaving aid, the solid shaving aid comprising polyethylene oxide, wherein the sheath has at least one opening in the skin engaging surface through which the shaving aid is released during shaving, and wherein a first one of the opposing ends of the device is at least partially closed to inhibit release of the shaving aid from the first one of the opposing ends of the device, wherein a portion of the sheath at the first one of the opposing ends of the device extends axially beyond the core and wherein one portion of the portion of the sheath extending axially beyond the core is bonded to a second portion of the portion of the sheath extending axially beyond the core to at least partially close the first one of the opposing ends of the device.

2. A razor cartridge, comprising:

a housing, a blade and a device for delivery of a shaving aid to a skin surface of a user, comprising opposing ends, and further comprising an elongated solid polymeric sheath comprising a water insoluble polymer, the sheath having a skin engaging surface extending along an outer surface thereof, and an internal solid polymeric core coextruded with the sheath and extending axially at least partially throughout and surrounded by the sheath, the core containing 50% to 100% by weight of a solid shaving aid, the solid shaving aid comprising polyethylene oxide, wherein the sheath has at least one opening in the skin engaging surface through which the shaving aid is released during shaving, and wherein a first one of the opposing ends of the device is at least partially closed to inhibit release of the shaving aid from the first one of the opposing ends of the device wherein a portion of the sheath at the first one of the opposing ends of the device extends axially beyond the core and wherein one portion of the portion of the sheath extending axially beyond the core is welded to a second portion of the portion of the sheath extending axially beyond the core to at least partially close the first one of the opposing ends of the device.

3. A razor cartridge, comprising:

a housing, a blade and a device for delivery of a shaving aid to a skin surface of a user, comprising opposing ends, and further comprising an elongated solid polymeric sheath comprising a water insoluble polymer, the sheath having a skin engaging surface extending along an outer surface thereof, and an internal solid polymeric core coextruded with the sheath and extending axially at least partially throughout and surrounded by the sheath, the core containing 50% to 100% by weight of a solid shaving aid, the solid shaving aid comprising polyethylene oxide, wherein the sheath has at least one opening in the skin engaging surface through which the shaving aid is released during shaving, and wherein a first one of the opposing ends of the device is at least partially closed to inhibit release of the shaving aid from the first one of the opposing ends of the device, and wherein the first one of the opposing ends of the device is at least partially closed by an application of a sealant.

* * * * *